US009533748B2

(12) United States Patent
Kuriyagawa et al.

(10) Patent No.: US 9,533,748 B2
(45) Date of Patent: Jan. 3, 2017

(54) OUTBOARD MOTOR CONTROL APPARATUS

(71) Applicant: HONDA MOTOR CO., LTD., Minato-Ku, Tokyo (JP)

(72) Inventors: Koji Kuriyagawa, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 46 days.

(21) Appl. No.: 14/616,334

(22) Filed: Feb. 6, 2015

(65) Prior Publication Data

US 2015/0151823 A1 Jun. 4, 2015

Related U.S. Application Data

(63) Continuation of application No. 13/115,171, filed on May 25, 2011, now abandoned.

(30) Foreign Application Priority Data

May 28, 2010 (JP) ..... 2010-123288

(51) Int. Cl.
*B63H 21/21* (2006.01)
*B63H 20/14* (2006.01)

(52) U.S. Cl.
CPC ..... *B63H 21/21* (2013.01); *B63H 20/14* (2013.01); *B63H 21/213* (2013.01)

(58) Field of Classification Search
CPC . B63H 21/21; B63H 21/213; B63H 2021/216; B63H 20/14
USPC ..... 440/1, 84, 86, 87
See application file for complete search history.

(56) References Cited

U.S. PATENT DOCUMENTS

| | | | | |
|---|---|---|---|---|
| 6,015,319 | A | 1/2000 | Tanaka | |
| 7,214,113 | B2 | 5/2007 | Kojima | |
| 7,214,164 | B2 | 5/2007 | Shomura et al. | |
| 7,238,071 | B2 | 7/2007 | Takada et al. | |
| 7,909,670 | B2 * | 3/2011 | Suzuki | B63H 21/213 440/86 |
| 7,976,354 | B2 | 7/2011 | Kubota et al. | |
| 8,075,353 | B2 | 12/2011 | Suzuki et al. | |
| 8,317,556 | B2 | 11/2012 | Suzuki et al. | |
| 2009/0221194 | A1 | 9/2009 | Suzuki et al. | |

FOREIGN PATENT DOCUMENTS

| | | | |
|---|---|---|---|
| JP | 10-291496 | A | 11/1998 |
| JP | 2009-243590 | A | 10/2009 |
| JP | 2011-246061 | A | 12/2011 |

* cited by examiner

*Primary Examiner* — Ajay Vasudeva
(74) *Attorney, Agent, or Firm* — Carrier Blackman & Associates, P.C.; Joseph P. Carrier; William D. Blackman

(57) ABSTRACT

In an apparatus for controlling operation of an outboard motor having an internal combustion engine, a transmission and a low-speed cruise controller controlling a rotational speed of the propeller to make the boat cruise at low speed, the low-speed cruise controller outputs an increase/decrease command of the propeller rotational speed in response to an operator's manipulation, and change the gear position from the second speed to the first speed when the decrease command is outputted under a condition where the gear position is in the second speed and an engine speed is equal to or lower than a predetermined speed. With this, it becomes possible to decrease the propeller rotational speed to the maximum extent, thereby making a boat cruise at very low speed.

10 Claims, 12 Drawing Sheets

OUTBOARD MOTOR CONTROL APPARATUS

CROSS-REFERENCE TO RELATED APPLICATIONS

This application is a continuation of U.S. application Ser. No. 13/115,171, filed 25 May 2011, which claims priority under 35 USC §119 based on Japanese patent application No. 2010-123288, filed on May 28, 2010. The subject matter of these priority documents are incorporated by reference herein in their entirety.

BACKGROUND OF THE INVENTION

1. Technical Field

This invention relates to an outboard motor control apparatus, particularly to an apparatus for controlling an outboard motor with a transmission.

2. Background Art

In recent years, there is proposed a technique for an outboard motor having a transmission interposed at a power transmission shaft between an internal combustion engine and a propeller to change an output of the engine in speed and transmit it to the propeller, as taught, for example, by Japanese Laid-Open Patent Application No. 2009-202778. In the reference, an intake air amount is regulated to control a rotational speed of the propeller, thereby implementing low-speed cruise control (trolling control) for making a boat cruise at low speed.

SUMMARY OF INVENTION

In such the low-speed cruise control, it is sometimes preferred to further lower the boat speed by decreasing the rotational speed of the propeller and in this case, the intake air amount of the engine is decreased to decrease the rotational speed. However, since the engine has to avoid stalling, it is difficult to decrease the rotational speed through the regulation of the intake air amount.

An object of this invention is therefore to overcome the foregoing problem by providing an apparatus for controlling an outboard motor having a transmission, which apparatus can decrease a rotational speed of a propeller to the maximum extent, thereby making a boat cruise at very low speed.

In order to achieve the object, this invention provides in the first aspect an apparatus for controlling operation of an outboard motor adapted to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed and transmitting power of the engine to the propeller with a gear ratio determined by established speed, and a low-speed cruise controller adapted to control a rotational speed of the propeller to make the boat cruise at low speed, wherein the low-speed cruise controller includes: a propeller rotational speed increase/decrease command outputter adapted to output an increase command and decrease command of the rotational speed of the propeller in response to manipulation by the operator; and a first-speed changer adapted to change the gear position from the second speed to the first speed through the transmission when the decrease command is outputted under a condition where the gear position is in the second speed and a speed of the engine is equal to or lower than a predetermined speed.

In order to achieve the object, this invention provides in the second aspect a method for controlling operation of an outboard motor adapted to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed and transmitting power of the engine to the propeller with a gear ratio determined by established speed, comprising the step of: controlling a rotational speed of the propeller to make the boat cruise at low speed, wherein the step of controlling includes the steps of: outputting an increase command and decrease command of the rotational speed of the propeller in response to manipulation by the operator; and changing the gear position from the second speed to the first speed through the transmission when the decrease command is outputted under a condition where the gear position is in the second speed and a speed of the engine is equal to or lower than a predetermined speed.

BRIEF DESCRIPTION OF DRAWINGS

The above and other objects and advantages of the invention will be more apparent from the following description and drawings in which.

DESCRIPTION OF EMBODIMENT

An embodiment of an outboard motor control apparatus according to the invention will now be explained with reference to the attached drawings.

Figure 1:
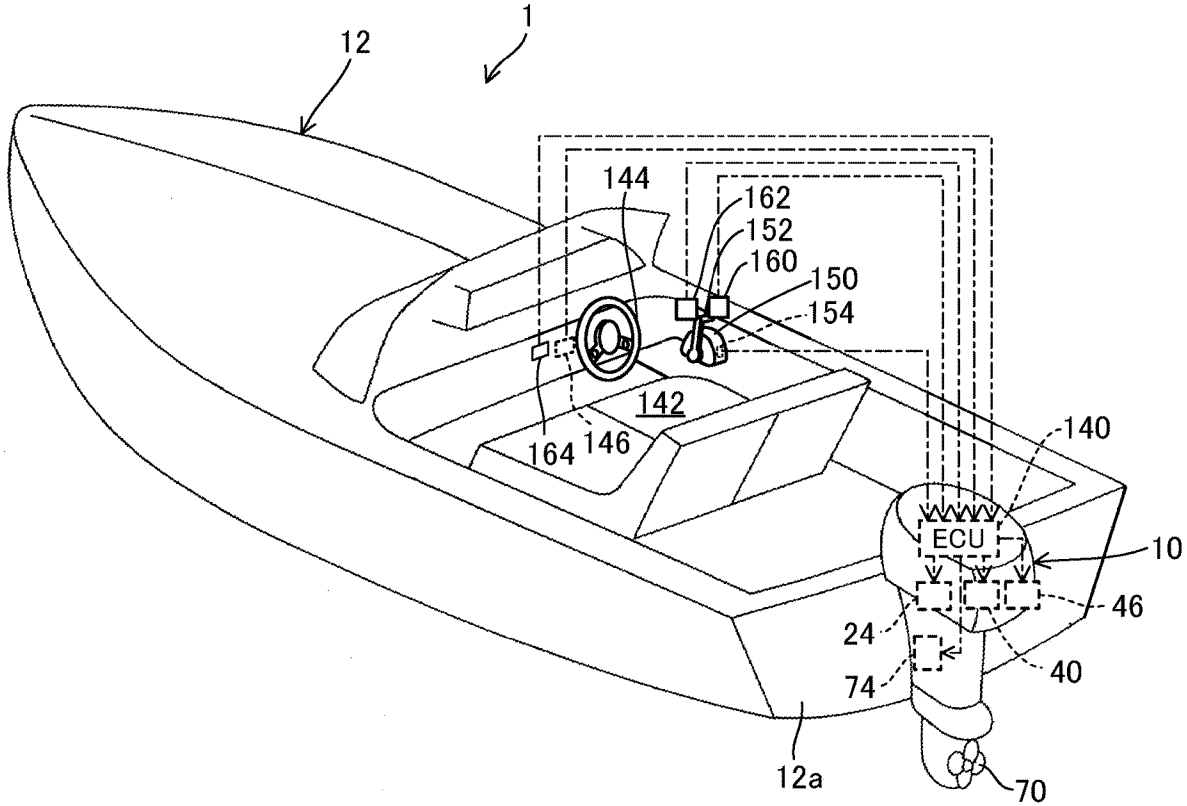
FIG. 1 is an overall schematic view of an outboard motor control apparatus including a boat according to an embodiment of the invention.
Figure 2:
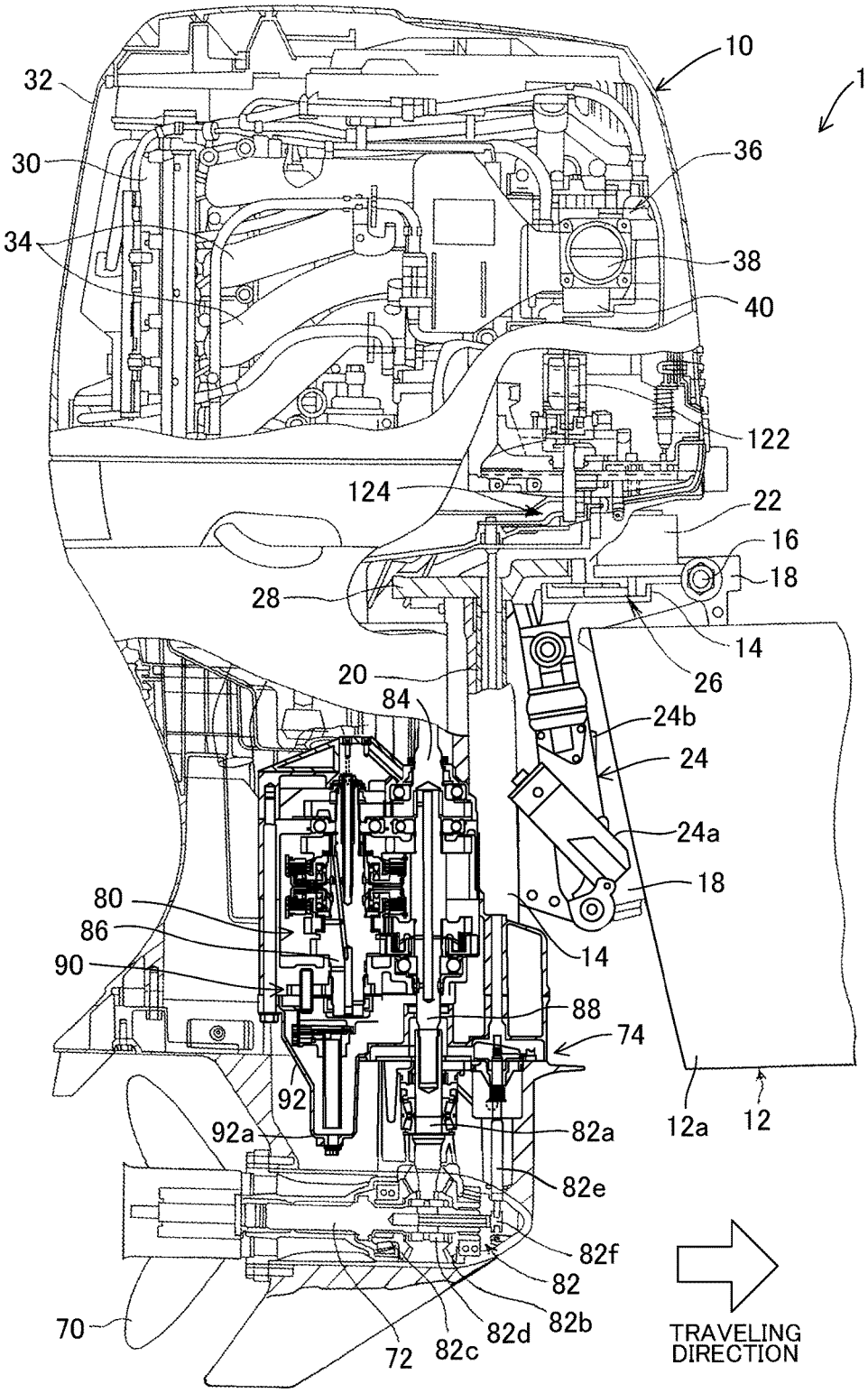
FIG. 2 is an enlarged sectional side view partially showing the outboard motor shown in FIG. 1.

FIG. 1 is an overall schematic view of an outboard motor control apparatus including a boat according to an embodiment of the invention. FIG. 2 is an enlarged sectional side view partially showing the outboard motor shown in FIG. 1 and FIG. 3 is an enlarged side view of the outboard motor.

Figure 3:
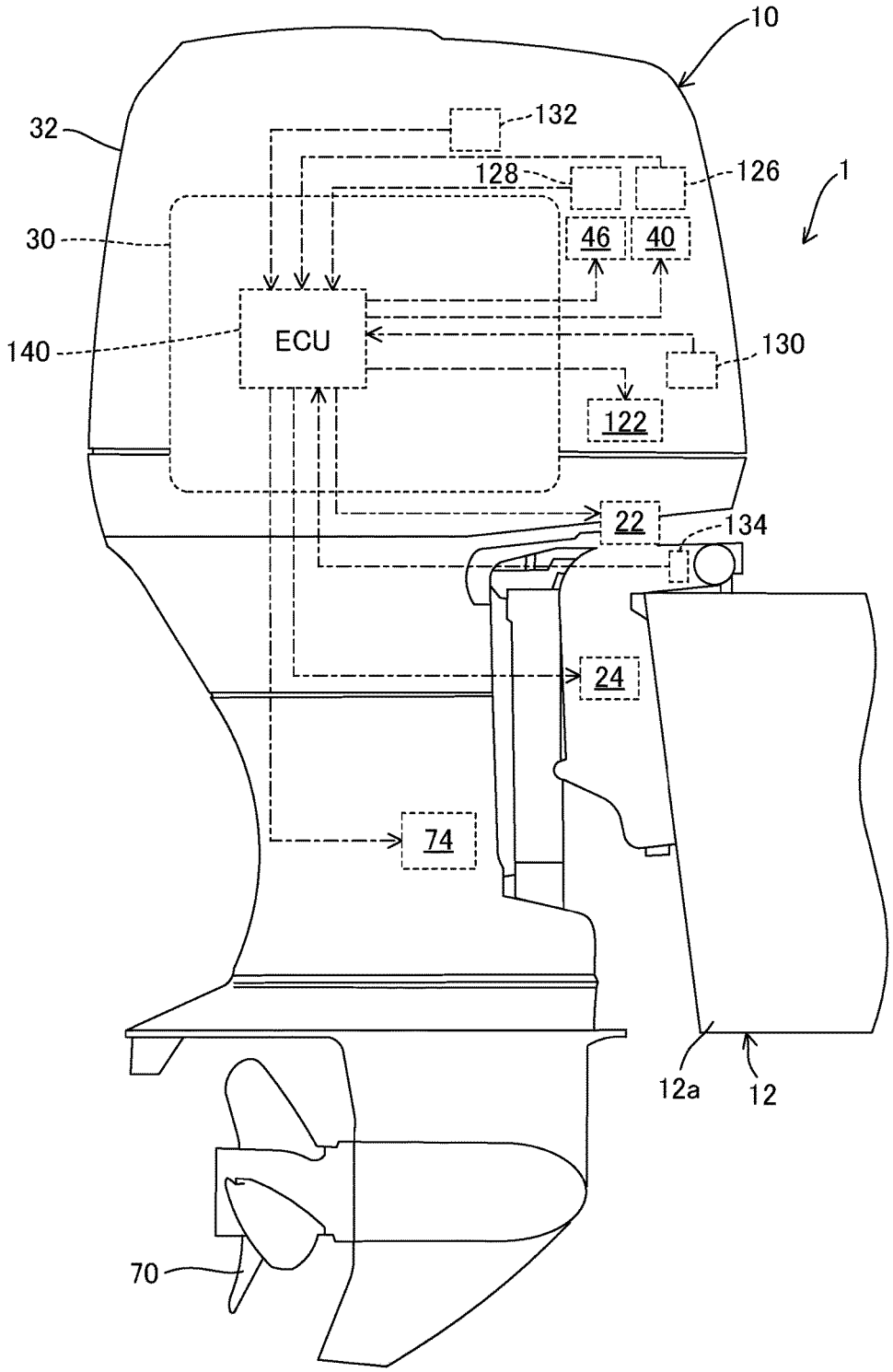
FIG. 3 is an enlarged side view of the outboard motor shown in FIG. 1.

In FIGS. 1 to 3, a symbol 1 indicates a boat or vessel whose hull 12 is mounted with the outboard motor 10. As clearly shown in FIG. 2, the outboard motor 10 is clamped (fastened) to the stern or transom 12*a* of the boat 1, more precisely, to the stern 12*a* of the hull 12 through a swivel case 14, tilting shaft 16 and stern brackets 18.

An electric steering motor (actuator) 22 for operating a shaft 20 which is housed in the swivel case 14 to be rotatable about the vertical axis and a power tilt-trim unit (actuator; hereinafter called the "trim unit") 24 for regulating a tilt angle and trim angle of the outboard motor 10 relative to the boat 1 (i.e., hull 12) by tilting up/down and trimming up/down are installed near the swivel case 14. A rotational output of the steering motor 22 is transmitted to the shaft 20 via a speed reduction gear mechanism 26 and mount frame 28, whereby the outboard motor 10 is steered about the shaft 20 as a steering axis to the right and left directions (steered about the vertical axis).

The trim unit 24 integrally comprises a hydraulic cylinder 24*a* for adjusting the tilt angle and a hydraulic cylinder 24*b* for adjusting the trim angle. In the trim unit 24, the hydraulic cylinders 24*a*, 24*b* are extended/contracted so that the swivel case 14 is rotated about the tilting shaft 16 as a rotational axis, thereby tiling up/down and trimming up/down the outboard motor 10. The hydraulic cylinders 24*a*, 24*b* are connected to a hydraulic circuit (not shown) in the outboard motor 10 and extended/contracted upon being supplied with operating oil therethrough.

An internal combustion engine (hereinafter referred to as the "engine") 30 is disposed in the upper portion of the outboard motor 10. The engine 30 comprises a spark-ignition, water-cooling gasoline engine with a displacement of 2,200 cc. The engine 30 is located above the water surface and covered by an engine cover 32.

An air intake pipe 34 of the engine 30 is connected to a throttle body 36. The throttle body 36 has a throttle valve 38 installed therein and an electric throttle motor (actuator) 40 for opening and closing the throttle valve 38 is integrally disposed thereto.

The output shaft of the throttle motor 40 is connected to the throttle valve 38 via a speed reduction gear mechanism (not shown). The throttle motor 40 is operated to open and close the throttle valve 38, thereby regulating the flow rate of the air sucked in the engine 30.

Figure 4:
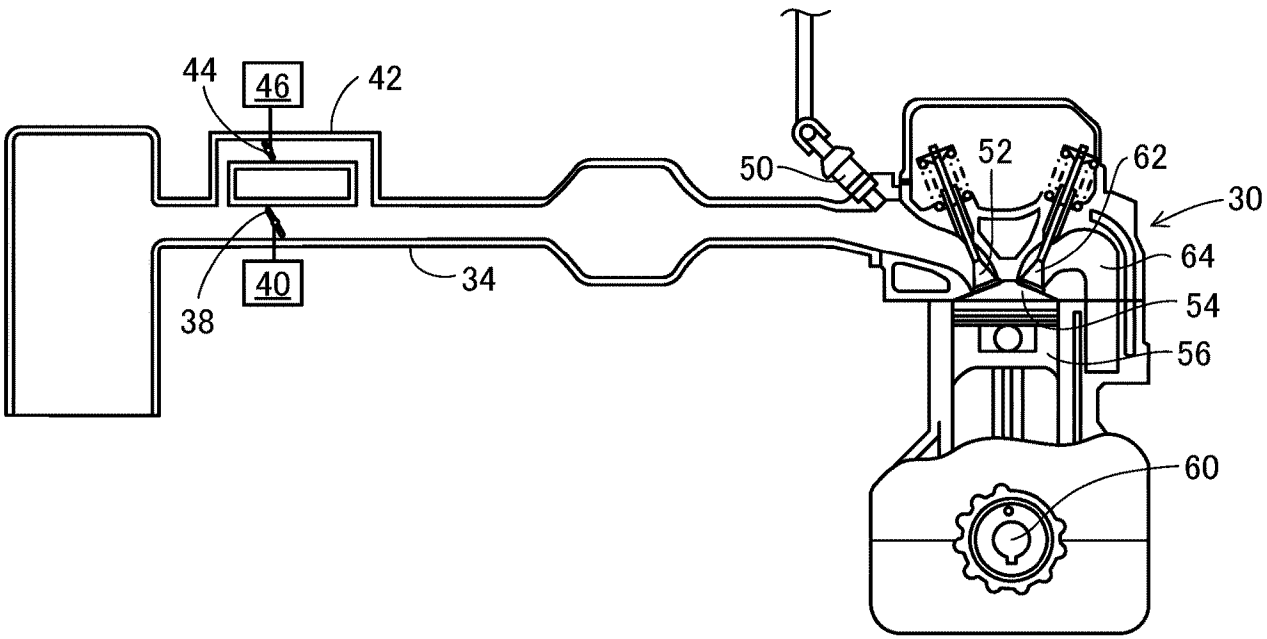
FIG. 4 is a schematic view of an internal combustion engine shown in FIG. 2, etc.

FIG. 4 is a schematic view of the engine 30 shown in FIG. 2, etc.

Explaining the engine 30 with reference to FIG. 4, the air intake pipe 34 is connected with a bypass (secondary air passage) 42 that bypasses the throttle valve 38 by interconnecting the upstream and down stream sides of the throttle valve 38. The bypass 42 is installed at the middle with a secondary air amount regulation valve 44 for regulating an intake air amount under the condition where the engine 30 is idling. The valve 44 is connected to an electric secondary air amount regulation motor (actuator) 46 via a speed reduction gear mechanism (not shown). When the motor 46 is operated, the valve 44 is opened and closed to regulate the amount of air flowing through the bypass 42.

An injector 50 is installed near an air intake port downstream of the throttle valve 38 in the air intake pipe 34 for injecting gasoline fuel into the intake air regulated by the throttle valve 38 and secondary air amount regulation valve 44. The injected fuel mixes with intake air to form an air-fuel mixture that flows into a combustion chamber 54 when an air intake valve 52 is opened.

The air-fuel mixture flown into the combustion chamber 54 is ignited by a spark plug (not shown) to burn, thereby driving a piston 56 downward in FIG. 4 to rotate a crankshaft 60. When an exhaust valve 62 is opened, the exhaust gas produced by the combustion passes through an exhaust pipe 64 to be discharged outside the engine 30.

Returning to the explanation on FIGS. 1 to 3, the outboard motor 10 further comprises a propeller shaft (power transmission shaft) 72 that is supported to be rotatable about the horizontal axis and attached with a propeller 70 at its one end to transmit power output of the engine 30 thereto, and a transmission (automatic transmission) 74 that is interposed at a location between the engine 30 and propeller shaft 72 and has a plurality of gear positions, i.e., first, second and third speeds.

The transmission 74 comprises a transmission mechanism 80 that is selectively changeable in gear positions and a shift mechanism 82 that can change a shift position among forward, reverse and neutral positions.

Figure 5:
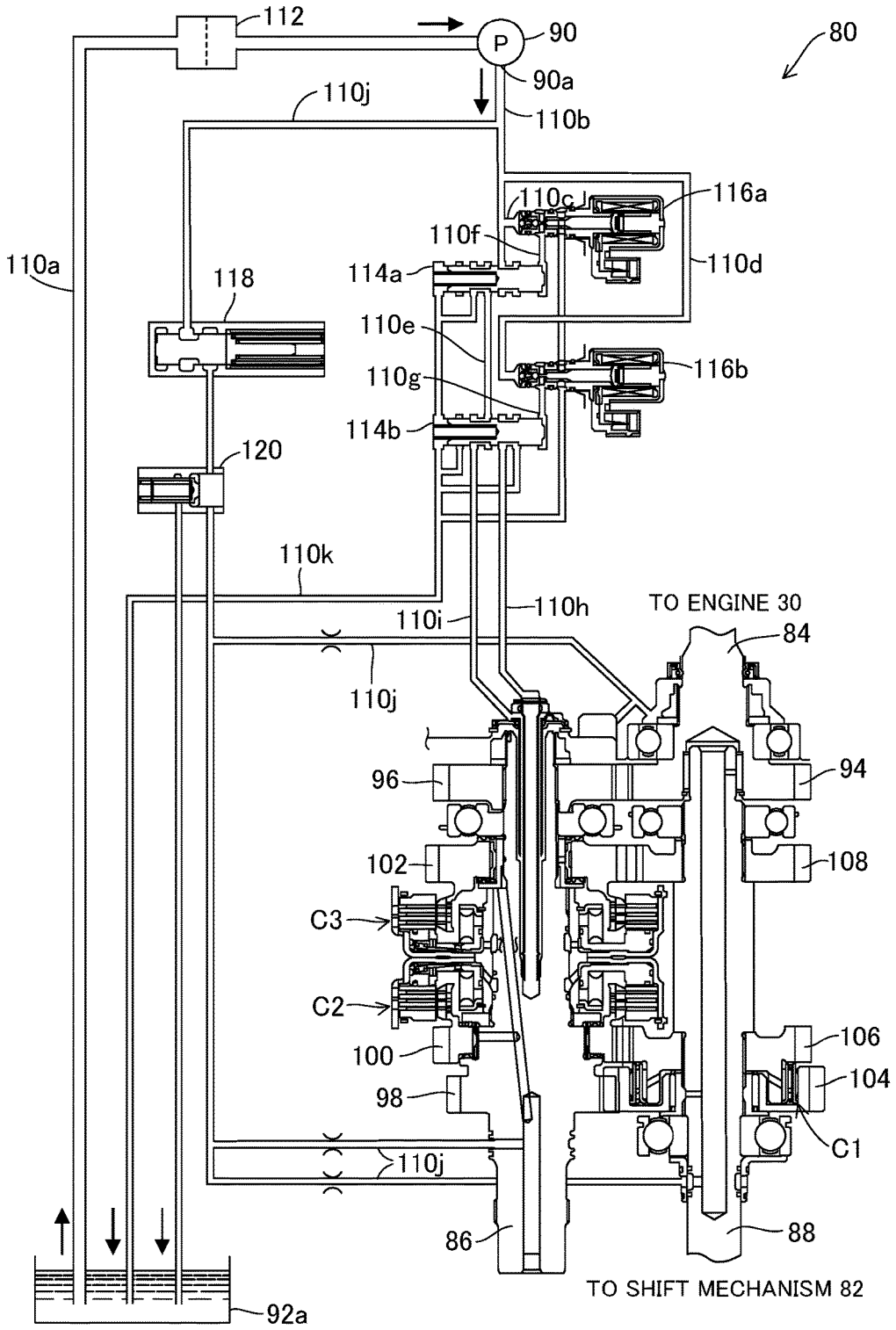
FIG. 5 is a hydraulic circuit diagram schematically showing a hydraulic circuit of a transmission mechanism shown in FIG. 2.

FIG. 5 is a hydraulic circuit diagram schematically showing a hydraulic circuit of the transmission mechanism 80.

As shown in FIGS. 2 and 5, the transmission mechanism 80 comprises a parallel-axis type transmission mechanism with distinct gear positions (ratios), which includes an input shaft (drive shaft) 84 connected to the crankshaft (not shown in FIGS. 2 and 5) of the engine 30, a countershaft 86 connected to the input shaft 84 through a gear, and a first connecting shaft 88 connected to the countershaft 86 through several gears. Those shafts 84, 86, 88 are installed in parallel.

The countershaft 86 is connected with a hydraulic pump (gear pump; shown in FIGS. 2 and 5) 90 that pumps up the operating oil (lubricating oil) and forwards it to transmission clutches and lubricated portions of the transmission mechanism 80 (explained later). The foregoing shafts 84, 86, 88, hydraulic pump 90 and the like are housed in a case 92 (shown only in FIG. 2). An oil pan 92*a* for receiving the operating oil is formed at the bottom of the case 92.

In the so-configured transmission mechanism 80, the gear installed on the shaft to be rotatable relative thereto is fixed on the shaft through the transmission clutch so that the transmission 74 is selectively changeable in the gear position to establish one of the three speeds (i.e., first to third speeds), and the output of the engine 30 is changed with the gear ratio determined by the established (selected) gear position (speed; gear) and transmitted to the propeller 70 through the shift mechanism 82 and propeller shaft 72. A gear ratio of the gear position (speed) is set to be the highest in the first speed and decreases as the speed changes to second and then third speed.

The further explanation on the transmission mechanism 50 will be made. As clearly shown in FIG. 5, the input shaft 84 is supported with an input primary gear 94. The countershaft 86 is supported with a counter primary gear 96 to be meshed with the input primary gear 94, and also supported with a counter first-speed gear 98, counter second-speed gear 100 and counter third-speed gear 102.

The first connecting shaft 88 is supported with an output first-speed gear 104 to be meshed with the counter first-speed gear 98, an output second-speed gear 106 to be meshed with the counter second-speed gear 100, and an output third-speed gear 108 to be meshed with the counter third-speed gear 102.

In the above configuration, when the output first-speed gear 104 supported to be rotatable relative to the first connecting shaft 88 is brought into a connection with the first connecting shaft 88 through a first-speed clutch C1, the first speed (gear position) is established. The first-speed clutch C1 comprises a one-way clutch. When a second-speed or third-speed hydraulic clutch C2 or C3 (explained later) is supplied with hydraulic pressure so that the second or third speed (gear position) is established and the rotational speed of the first connecting shaft 88 becomes greater than that of the output first-speed gear 104, the first-speed clutch C1 makes the output first-speed gear 104 rotate idly (i.e., rotate without being meshed).

When the counter second-speed gear 100 supported to be rotatable relative to the countershaft 86 is brought into a connection with the countershaft 86 through the second-speed hydraulic clutch (transmission clutch) C2, the second speed (gear position) is established. Further, when the counter third-speed gear 102 supported to be rotatable relative to the countershaft 86 is brought into a connection with the countershaft 86 through the third-speed hydraulic clutch (transmission clutch) C3, the third speed (gear position) is established. The hydraulic clutches C2, C3 connect the gears 100, 102 to the countershaft 86 upon being supplied with the hydraulic pressure, while making the gears 100, 102 rotate idly when the hydraulic pressure is not supplied.

The interconnections between the gears and shafts through the clutches C1, C2, C3 are performed by controlling the hydraulic pressure supplied from the pump 90 to the hydraulic clutches C2, C3.

The further explanation will be made. When the oil pump 90 is driven by the engine 30, it pumps up the operating oil in the oil pan 92*a* to be drawn through an oil passage 110*a* and strainer 112 and forwards it from a discharge port 90*a* to a first switching valve 114*a* through an oil passage 110*b* and to first and second electromagnetic solenoid valves (linear solenoid valves) 116*a*, 116*b* through oil passages 110*c*, 110*d*.

The first switching valve 114*a* is connected to a second switching valve 114*b* through an oil passage 110*e*. Each of the valves 114*a*, 114*b* has a movable spool installed therein and the spool is urged by a spring at its one end (left end in the drawing) toward the other end. The valves 114*a*, 114*b* are connected on the sides of the other ends of the spools with the first and second solenoid valves 116*a*, 116*b* through oil passages 110*f*, 110*g*, respectively.

Upon being supplied with current (i.e., made ON), a spool housed in the first solenoid valve 116*a* is displaced to output the hydraulic pressure supplied from the pump 90 through the oil passage 110*c* to the other end side of the spool of the first switching valve 114*a*. Accordingly, the spool of the first switching valve 114*a* is displaced to its one end side, thereby forwarding the operating oil in the oil passage 110*b* to the oil passage 110*e*.

Similarly to the first solenoid valve 116*a*, upon being supplied with current (i.e., made ON), a spool of the second solenoid valve 116*b* is displaced to output the hydraulic pressure supplied from the pump 90 through the oil passage 110*d* to the other end side of the spool of the second switching valve 114*b*. Accordingly, the spool of the second switching valve 114*b* is displaced to its one end side, thereby forwarding the operating oil in the oil passage 110*e* to the second-speed hydraulic clutch C2 through the oil passage 110*h*. In contrast, when the second solenoid valve 116*b* is not supplied with current (made OFF) and no hydraulic pressure is outputted to the other end side of the second switching valve 114*b*, the operating oil in the oil passage 110*e* is forwarded to the third-speed hydraulic clutch C3 through the oil passage 110*i*.

When the first and second solenoid valves 116*a*, 116*b* are both made OFF, the hydraulic pressure is not supplied to the hydraulic clutches C2, C3 and hence, the output first-speed gear 104 and first connecting shaft 88 are interconnected through the first-speed clutch C1 so that the first speed is established.

When the first and second solenoid valves 116*a*, 116*b* are both made ON, the hydraulic pressure is supplied to the second-speed hydraulic clutch C2 and accordingly, the counter second-speed gear 100 and countershaft 86 are interconnected so that the second speed is established. Further, when the first solenoid valve 116*a* is made ON and the second solenoid valve 116*b* is made OFF, the hydraulic pressure is supplied to the third-speed hydraulic clutch C3 and accordingly, the counter third-speed gear 102 and countershaft 86 are interconnected so that the third speed is established.

Thus, one of the gear positions of the transmission 74 is selected (i.e., transmission control is conducted) by controlling ON/OFF of the first and second switching valves 114*a*, 114*b*.

Note that the operating oil (lubricating oil) from the hydraulic pump 90 is also supplied to the lubricated portions (e.g., the shafts 84, 86, 88, etc.) of the transmission 74 through the oil passage 110*b*, an oil passage 110*j*, a regulator valve 118 and a relief valve 120. Also, the first and second switching valves 114*a*, 114*b* and the first and second solenoid valves 116*a*, 116*b* are connected with an oil passage 110*k* adapted to relieve pressure.

The explanation on FIG. 2 is resumed. The shift mechanism 82 comprises a second connecting shaft 82*a* that is connected to the first connecting shaft 88 of the transmission mechanism 80 and installed parallel to the vertical axis to be rotatably supported, a forward bevel gear 82*b* and reverse bevel gear 82*c* that are connected to the second connecting shaft 82*a* to be rotated, a clutch 82*d* that can engage the propeller shaft 72 with either one of the forward bevel gear 82*b* and reverse bevel gear 82*c*, and other components.

The interior of the engine cover 32 is disposed with an electric shift motor (actuator) 122 that drives the shift mechanism 82. The output shaft of the shift motor 122 can be connected via a speed reduction gear mechanism 124 with the upper end of a shift rod 82*e* of the shift mechanism 82. When the shift motor 122 is operated, its output appropriately displaces the shift rod 82*e* and a shift slider 82*f* to move the clutch 82*d* to change the shift position among forward, reverse and neutral positions.

When the shift position is the forward or reverse position, the rotational output of the first connecting shaft 88 is transmitted via the shift mechanism 82 to the propeller shaft 72 to rotate the propeller 70 to generate the thrust in one of the directions making the boat 1 move forward or backward. The outboard motor 10 is equipped with a power source (not shown) such as a battery or the like attached to the engine 30 to supply operating power to the motors 22, 40, 46, 122, etc.

As shown in FIG. 3, a throttle opening sensor 126 is installed near the throttle valve 38 and produces an output or signal indicative of opening of the throttle valve 38, i.e., throttle opening TH, while another throttle opening sensor 128 is installed near the secondary air amount regulation valve 44 and produces an output or signal indicative of opening TH2 of the valve 44.

A neutral switch 130 is installed near the shift rod 82*e* and produces an ON signal when the shift position of the transmission 74 is neutral and an OFF signal when it is forward or reverse. A crank angle sensor 132 is installed near the crankshaft of the engine 30 and produces a pulse signal at every predetermined crank angle.

A trim angle sensor (i.e., a rotation angle sensor such as a rotary encoder) 134 is installed near the tilting shaft 16 and produces an output or signal corresponding to a trim angle θ of the outboard motor 10 (i.e., a rotation angle of the outboard motor 10 about its pitching axis relative to the hull 12).

The outputs of the foregoing sensors and switch are sent to an Electronic Control Unit (ECU) 140 disposed in the outboard motor 10. The ECU 140 which has a microcomputer comprising a CPU, ROM, RAM and other devices is installed in the engine cover 32 of the outboard motor 10.

As shown in FIG. 1, a steering wheel 144 is installed near a cockpit (the operator's seat) 142 of the hull 12 to be manipulated or rotated by the operator (not shown). A steering angle sensor 146 attached on a shaft (not shown) of the steering wheel 144 produces an output or signal corresponding to the steering angle applied or inputted by the operator through the steering wheel 144.

A remote control box 150 provided near the cockpit 142 is equipped with a shift/throttle lever (throttle lever) 152 installed to be manipulated by the operator. The lever 152 can be moved or swung in the front-back direction from the initial position and is used by the operator to input a forward/reverse change command and an engine speed regulation command (i.e., a desired engine speed NEd) including an acceleration/deceleration command or instruction for the engine 30. A lever position sensor 154 is installed in the remote control box 150 and produces an output or signal corresponding to a position of the lever 152.

Figure 6:
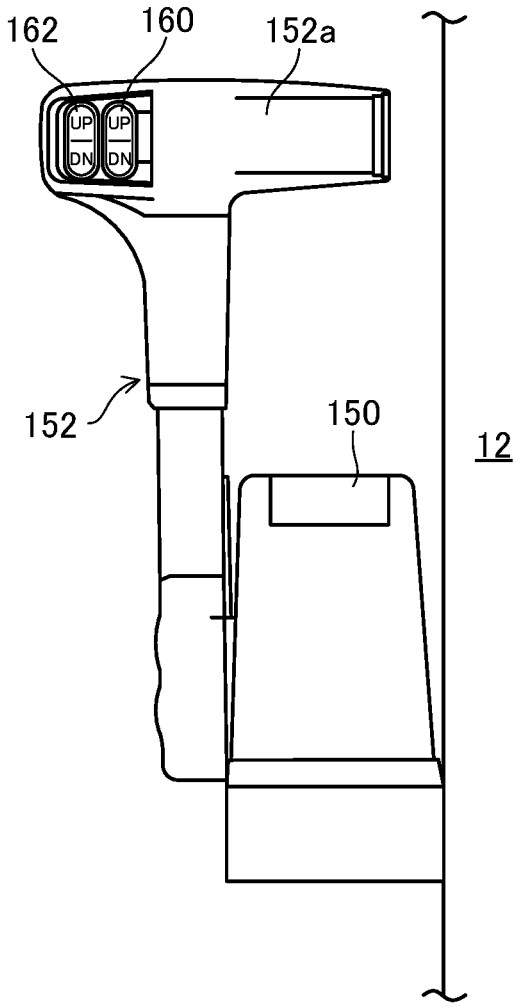
FIG. 6 is an enlarged side view of a remote control box and shift/throttle lever shown in FIG. 1 when viewed from the rear of the boat.

FIG. 6 is an enlarged side view of the remote control box 150 and lever 152 shown in FIG. 1 when viewed from the rear of the boat.

The lever 152 is equipped with a grip 152*a* to be gripped or held by the operator and the grip 152*a* is provided with a power tilt-trim switch (hereinafter called the "trim switch") 160 and trolling switch (switch; propeller rotational speed increase/decrease command outputter) 162. The switches 160, 162 are installed to be manually operated by the operator.

The trim switch 160 comprises pushing type switches including an up switch ("UP" in FIG. 6) and a down switch ("DN"). When the up switch is pressed by the operator, the trim switch 160 produces an output or signal indicative of a tilt-up/trim-up command, while when the down switch is pressed, producing an output or signal indicative of a tilt-down/trim-down command.

Similarly, the trolling switch 162 comprises pushing type switches including an up switch ("UP" in FIG. 6) and a down switch ("DN") and produces an output or signal (ON signal) indicative of a command to make the rotational speed of the propeller 70 increase when the up switch is pressed, while producing that (ON signal) indicative of a command to make the rotational speed of the propeller 70 decrease when the down switch is pressed. Thus the trolling switch 162 outputs a propeller rotational speed increase/decrease command in response to the manipulation by the operator.

As shown in FIG. 1, a switch 164 is also provided near the cockpit 142 to be manually operated by the operator to input a fuel consumption decreasing command for decreasing fuel consumption of the engine 30. The switch 164 is manipulated or pressed when the operator desires to travel the boat 1 with high fuel efficiency, and upon the manipulation, it produces a signal (ON signal) indicative of the fuel consumption decreasing command. The outputs of the sensors 146, 154 and switches 160, 162, 164 are also sent to the ECU 140.

Based on the inputted outputs, the ECU 140 controls the operation of the motors 22, 122, while performing the transmission control of the transmission 74 and the trim angle control for regulating the trim angle θ through the trim unit 24.

The ECU 140 also detects or calculates a speed of the engine 30, i.e., engine speed NE by counting the output pulses from the crank angle sensor 102 and based on the detected engine speed NE and throttle opening TH, controls the operation of the throttle motor 40 and secondary air amount regulation motor 46 so that the engine speed NE is converged to the desired engine speed NEd (precisely, the desired engine speed NEd set based on the lever 152 position and the signal from the trolling switch 162; explained later), thereby regulating the intake air amount of the engine 30 to perform propeller rotational speed control for controlling the rotational speed of the propeller 70.

Thus, the outboard motor control apparatus according to the embodiment is a Drive-By-Wire type apparatus whose operation system (steering wheel 144, lever 152) has no mechanical connection with the outboard motor 10.

Figure 7:
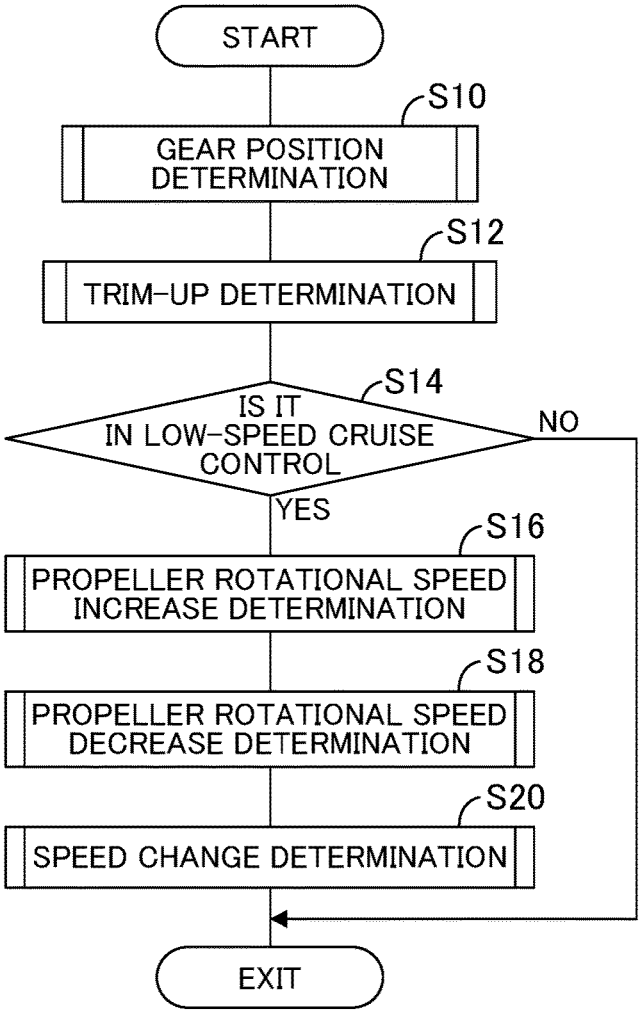
FIG. 7 is a flowchart showing transmission control operation, trim angle control operation and propeller rotational speed control operation by an electronic control unit shown in FIG. 1.

FIG. 7 is a flowchart showing transmission control operation, trim angle control operation and propeller rotational speed control operation by the ECU 140. The illustrated program is executed by the ECU 140 at predetermined intervals, e.g., 100 milliseconds.

The program begins at S10, in which the operation for determining which one from among the first to third speeds of the transmission 74 should be selected, is conducted.

Figure 8:
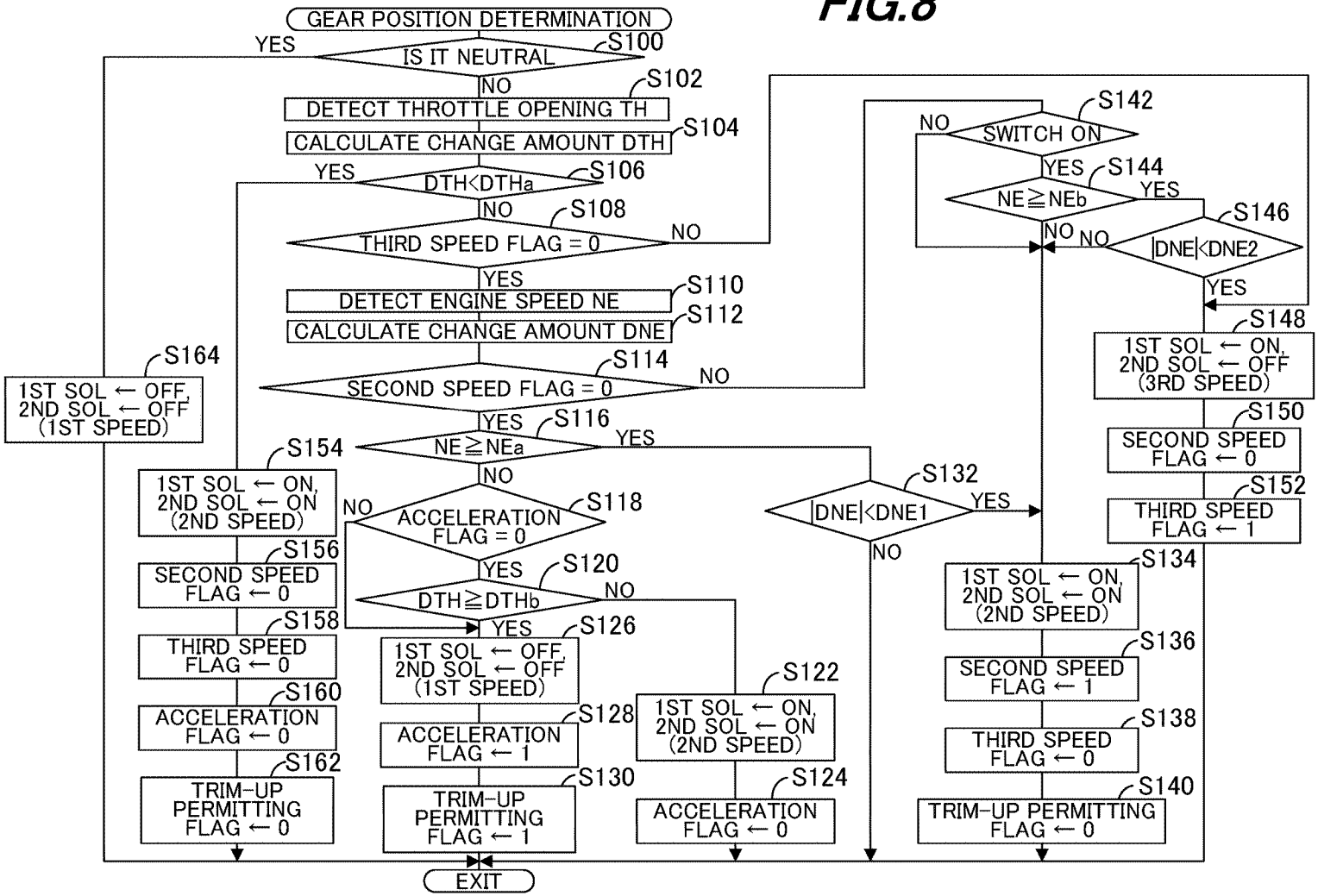
FIG. 8 is a subroutine flowchart showing the operation of gear position determination in the FIG. 7 flowchart.

FIG. 8 is a subroutine flowchart showing the operation of the gear position determination. First, in S100, it is determined whether the shift position of the transmission 74 is at the neutral position. This determination is made by checking as to whether the neutral switch 130 outputs the ON signal. When the result in S100 is negative, i.e., it is determined to be in gear, the program proceeds to S102, in which the throttle opening TH is detected or calculated from the output of the throttle opening sensor 126, and to S104, in which a change amount (variation) DTH of the detected throttle opening TH per unit time (e.g., 500 milliseconds) is detected or calculated.

The program proceeds to S106, in which it is determined whether the deceleration is instructed to the engine 30 by the operator, i.e., whether the engine 30 is in the operating condition to decelerate the boat 1. This determination is made by checking as to whether the throttle valve 38 is operated in the closing direction. More specifically, when the change amount DTH is less than a deceleration-determining predetermined value DTHa (e.g., −0.5 degree) set to a negative value, the throttle valve 38 is determined to be operated in the closing direction (i.e., the deceleration is instructed to the engine 30).

When the result in S106 is negative, the program proceeds to S108, in which it is determined whether the bit of an after-acceleration third-speed changed flag (explained later; hereinafter called the "third speed flag") which indicates that the gear position has been changed to the third speed after the acceleration was completed, is 0. Since the initial value of this flag is 0, the result in S108 in the first program loop is generally affirmative and the program proceeds to S110.

The program proceeds to S110, in which the engine speed NE is detected or calculated from the output of the crank angle sensor 132 and to S112, in which a change amount (variation) DNE of the engine speed NE is calculated. The change amount DNE is obtained by subtracting the engine speed NE detected in the present program loop from that detected in the previous program loop.

Next, the program proceeds to S114, in which it is determined whether the bit of an after-acceleration second-speed changed flag (hereinafter called the "second speed flag") is 0. The bit of this flag is set to 1 when the gear position is changed from the first speed to the second speed after the acceleration is completed, and otherwise, reset to 0.

Since the initial value of the second speed flag is also 0, the result in S114 in the first program loop is generally affirmative and the program proceeds to S116, in which it is determined whether the engine speed NE is equal to or greater than a second-speed change prescribed speed NEa. The prescribed speed NEa will be explained later.

Since the engine speed NE is generally less than the prescribed speed NEa in a program loop immediately after the engine start, the result in S116 is negative and the program proceeds to S118, in which it is determined whether the bit of an acceleration determining flag (explained later; indicated by "acceleration flag" in the drawing) is 0. Since the initial value of this flag is also 0, the result in S118 in the first program loop is generally affirmative and the program proceeds to S120.

In S120, it is determined whether the acceleration (precisely, the rapid acceleration) is instructed to the engine 30 by the operator, i.e., whether the engine 30 is in the operating condition to (rapidly) accelerate the boat 1. This determination is made by checking as to whether the throttle valve 38 is operated in the opening direction rapidly.

Specifically, the change amount DTH of the throttle opening TH detected in S104 is compared with an acceleration-determining predetermined value DTHb and when the change amount DTH is equal to or greater than the predetermined value DTHb, it is determined that the throttle valve 38 is operated in the opening direction rapidly, i.e., the acceleration is instructed to the engine 30. The predetermined value DTHb is set to a value (positive value, e.g., 0.5 degree) greater than the deceleration-determining predetermined value DTHa, as a criterion for determining whether the acceleration is instructed to the engine 30.

When the result in S120 is negative, i.e., it is determined that neither the acceleration nor the deceleration is instructed to the engine 30, the program proceeds to S122, in which the first and second solenoid valves 116*a*, 116*b* (indicated by "1ST SOL," "2ND SOL" in the drawing) are both made ON to select the second speed in the transmission 74, and to S124, in which the bit of the acceleration determining flag is reset to 0.

On the other hand, when the result in S120 is affirmative, the program proceeds to S126, in which the first and second solenoid valves 116*a*, 116*b* are both made OFF to change the gear position (shift down the gear) of the transmission 74 from the second speed to the first speed. As a result, the output torque of the engine 30 is amplified through the transmission 74 (more precisely, the transmission mechanism 80) which has been shifted down to the first speed, and transmitted to the propeller 70 via the propeller shaft 72, thereby improving the acceleration performance.

Then the program proceeds to S128, in which the bit of the acceleration determining flag is set to 1. Specifically, the bit of this flag is set to 1 when the change amount DTH of the throttle opening TH is equal to or greater than the acceleration-determining predetermined value DTHb and the transmission 74 is changed from the second speed to the first speed, and otherwise, reset to 0. Upon setting of the bit of the acceleration determining flag to 1, the result in S118 in the next and subsequent loops becomes negative and the program skips S120.

Thus, since the transmission 74 is set in the second speed during a period from when the engine 30 is started until the acceleration is instructed (i.e., during the normal operation), it becomes possible to ensure the usability of the outboard motor 10 similarly to that of an outboard motor having no transmission.

Next, the program proceeds to S130, in which the bit of a trim-up permitting flag (initial value 0) is set to 1, whereafter the program is terminated. Specifically, the bit of this flag being set to 1 means that the change amount DTH is equal to or greater than the predetermined value DTHb and the transmission 74 is changed to the first speed, in other words, the trim-up operation to be conducted based on the engine speed NE is permitted (explained later), while that being reset to 0 means that the trim-up operation is not needed, i.e., for example, the deceleration is instructed to the engine 30.

After the transmission 74 is changed to the first speed, when the engine speed NE is gradually increased and the acceleration through the torque amplification in the first speed is completed (i.e., the acceleration range is saturated), the engine speed NE reaches the prescribed speed NEa. Consequently, in the following program loop, the result in S116 becomes affirmative and the program proceeds to S132 onward. The prescribed speed NEa is set to a relatively high value (e.g., 6000 rpm) as a criterion for determining whether the acceleration in the first speed is completed.

In S132, it is determined whether the engine speed NE is stable, i.e., the engine 30 is stably operated. This determination is made by comparing an absolute value of the change amount DNE of the engine speed NE with a first prescribed value DNE1. When the absolute value is less than the first prescribed value DNE1, the engine speed NE is determined to be stable. The first prescribed value DNE1 is set as a criterion (e.g., 500 rpm) for determining whether the engine speed NE is stable, i.e., the change amount DNE is relatively small.

When the result in S132 is negative, the program is terminated with the first speed being maintained, and when the result is affirmative, the program proceeds to S134, in which the first and second solenoid valves 116*a*, 116*b* are both made ON to change the transmission 74 (shift up the gear) from the first speed to the second speed. It causes the increase in the rotational speed of the shaft 82*a* and that of the propeller shaft 72, so that the boat speed reaches the maximum speed (in a range of the engine performance), thereby improving the speed performance.

Then the program proceeds to S136, in which the bit of the second speed flag is set to 1, to S138, in which the bit of the third speed flag is reset to 0 and to S140, in which the bit of the trim-up permitting flag is reset to 0. As a result, the trim-up operation of the outboard motor 10 is stopped in another program (explained later) at the same time (synchronously) when the gear position is changed from the first speed to the second speed.

When the bit of the second speed flag is set to 1 in S136, the result in S114 in the next and subsequent program loops becomes negative and the program proceeds to S142. Thus the process of S142 onward is conducted when the bit of the second speed flag is set to 1, i.e., the gear position is changed to the second speed after the acceleration in the first speed is completed.

In S142, it is determined whether the switch 164 outputs the ON signal, i.e., whether the fuel consumption decreasing command for the engine 30 is inputted by the operator. When the result in S142 is negative, the program proceeds to S134 to S140 mentioned above, while when the result is affirmative, proceeding to S144, in which it is determined whether the engine speed NE is equal to or greater than a third-speed change prescribed speed NEb. The prescribed speed NEb is set to a value (e.g., 5000 rpm) slightly lower than the second-speed change prescribed speed NEa, as a criterion for determining whether it is possible to change the gear position to the third speed (explained later).

When the result in S144 is affirmative, the program proceeds to S146, in which, similarly to S132, it is determined whether the engine speed NE is stable. Specifically, the absolute value of the change amount DNE of the engine speed NE is compared with a second prescribed value DNE2 and when it is less than the second prescribed value DNE2, the engine speed NE is determined to be stable. The second prescribed value DNE2 is set as a criterion (e.g., 500 rpm) for determining whether the change amount DNE is relatively small and the engine speed NE is stable.

When the result in S146 or S144 is negative, the program proceeds to S134 and when the result in S146 is affirmative, the program proceeds to S148, in which the first solenoid valve 116*a* is made ON and the second solenoid valve 116*b* is made OFF to change the transmission 74 (shift up the gear) from the second speed to the third speed. As a result, the engine speed NE is decreased, thereby decreasing the fuel consumption, i.e., improving the fuel efficiency.

Next, the program proceeds to S150, in which the bit of the second speed flag is reset to 0 and to S152, in which the bit of the third speed flag is set to 1. Thus, the third speed flag is set to 1 when the gear position is changed from the second speed to the third speed after the acceleration is completed, and otherwise, reset to 0. Note that, in a program loop after the bit of the third speed flag is set to 1, the result in S108 is negative and the process of S148 to S152 is conducted, whereafter the program is terminated with the third speed being maintained.

When the result in S106 is affirmative, the program proceeds to S154, in which the first and second solenoid valves 116*a*, 116*b* are both made ON to change the gear position to the second speed. Then the program proceeds to S156, S158, S160 and S162, in which the bits of the second speed flag, third speed flag, acceleration determining flag and trim-up permitting flag are all reset to 0.

When the lever 152 is manipulated by the operator to change the shift position of the transmission 74 to neutral, the result in S100 is affirmative and the program proceeds to S164, in which the first and second solenoid valves 116*a*, 116*b* are both made OFF to change the transmission 74 from the second speed to the first speed.

Returning to the explanation on the FIG. 7 flowchart, the program proceeds to S12, in which it is determined whether the trim-up operation of the outboard motor 10 should be conducted.

Figure 9:
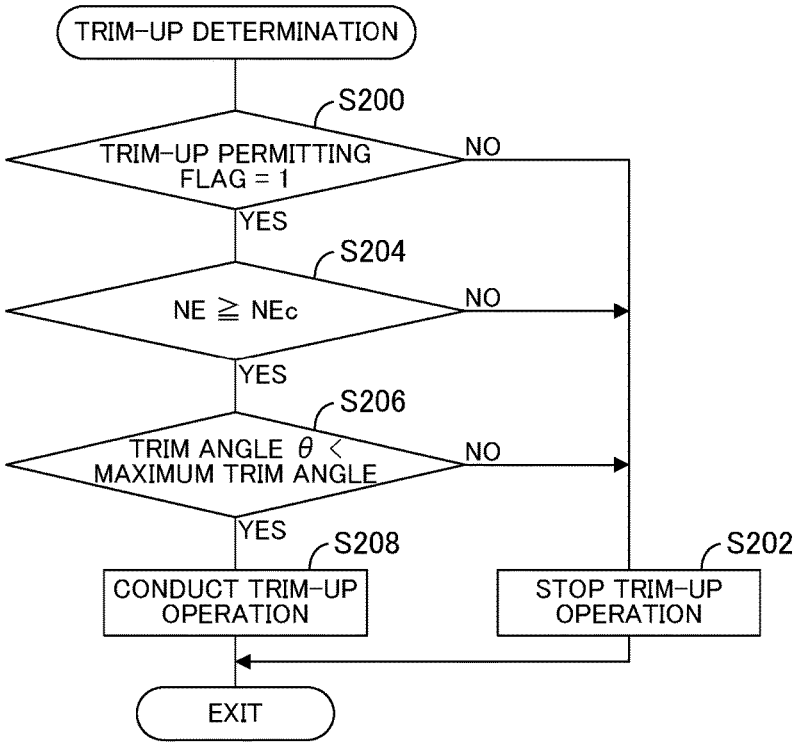
FIG. 9 is a subroutine flowchart showing the operation of trim-up determination in the FIG. 7 flowchart.

FIG. 9 is a subroutine flowchart showing the operation of the trim-up determination. As shown in FIG. 9, in S200, it is determined whether the bit of the trim-up permitting flag is 1. When the result in S200 is negative, since it means that the trim-up operation is not needed, the program proceeds to S202, in which the trim-up operation is stopped, more precisely, not conducted. When the result in S200 is affirmative, i.e., when the change amount DTH is equal to or greater than the predetermined value DTHb and the transmission 74 is changed to the first speed, the program proceeds to S204, in which it is determined based on the engine speed NE whether it is immediately before the acceleration in the first speed is completed and the transmission 74 is changed back from the first speed to the second speed.

Specifically, the engine speed NE is compared to a trim-up prescribed speed NEc. When the engine speed NE is equal to or greater than the prescribed speed NEc, it is determined to be immediately before the acceleration in the first speed is completed and the gear position is changed back from the first speed to the second speed. The prescribed speed NEc is set as a criterion (e.g., 5000 rpm) for determining whether it is immediately before the acceleration is completed, more precisely, set lower than the second-speed change prescribed speed NEa which is the threshold value used when the gear position is changed back from the first speed to the second speed.

When the result in S204 is negative, since it is not the time to start the trim-up operation, the program proceeds to S202, whereafter the program is terminated without conducting the trim-up operation. When the result in S204 is affirmative, the program proceeds to S206, in which it is determined whether the trim angle θ is less than the maximum trim angle (the maximum value in the possible trim angle range which can be reached through the trim-up operation by the trim unit 24, e.g., 10 degrees).

When the result in S206 is negative, since it is impossible to further trim up the outboard motor 10, the program proceeds to S202, in which the trim-up operation is stopped or not conducted. On the other hand, when the result in S206 is affirmative, the program proceeds to S208, in which the trim unit 24 is operated to start and conduct the trim-up operation. Thus, the trim-up operation is started before the acceleration is completed and the transmission 74 is changed back from the first speed to the second speed, thereby increasing the boat speed.

In the next program loop, when the result in S200 is negative, i.e., when the gear position is changed from the first speed to the second speed in S134 and the bit of the trim-up permitting flag is reset to 0 in S140, the program proceeds to S202, in which the trim-up operation is stopped or not conducted.

In S200, it is also determined whether the signal indicating the trim-up/down command or the like is outputted upon the manipulation of the trim switch 160 by the operator. When the signal is outputted, the trim unit 24 is operated in response to the outputted signal regardless of the bit of the trim-up permitting flag. Owing to this configuration, the operator can operate the trim unit 24 by manipulating the trim switch 160, thereby enabling to regulate the trim angle θ at any time.

Returning to the explanation on the FIG. 7 flowchart, the program proceeds to S14, in which it is determined whether low-speed cruise control (trolling control) for controlling the propeller rotational speed to make the boat 1 cruise at relatively low speed, is in execution. Specifically, when the propeller rotational speed increase/decrease command is outputted from the trolling switch 162, the low-speed cruise control is determined to be in execution.

When the result in S14 is negative, the remaining steps are skipped and when the result is affirmative, the program proceeds to S16, in which it is determined whether the rotational speed of the propeller 70 should be increased.

Figure 10:
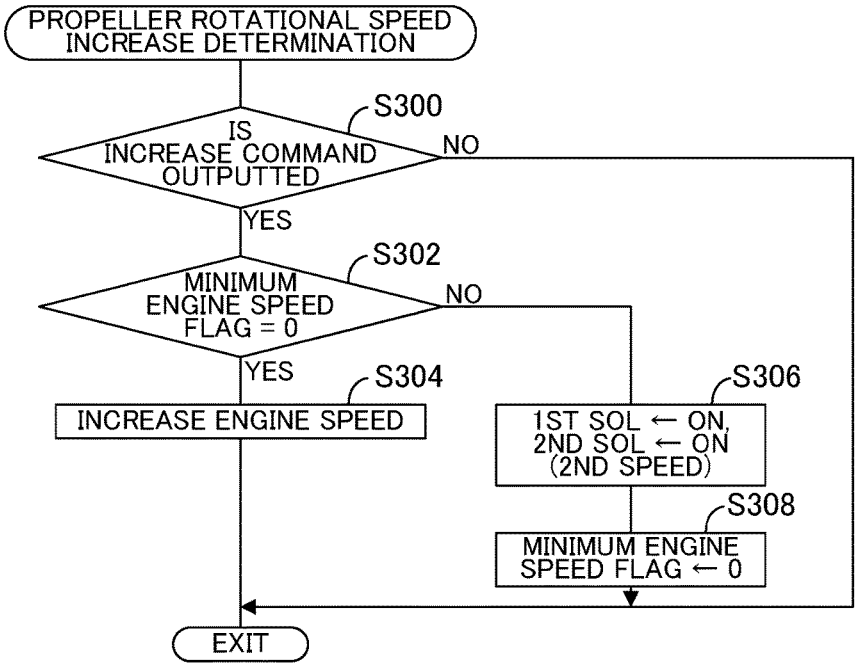
FIG. 10 is a subroutine flowchart showing the operation of propeller rotational speed increase determination in the FIG. 7 flowchart.

FIG. 10 is a subroutine flowchart showing the operation of the propeller rotational speed increase determination. First, in S300, it is determined whether the propeller rotational speed increase command is outputted from the trolling switch 162, i.e., whether the increase in the propeller rotational speed is instructed by the operator. When the result in S300 is negative, the remaining steps are skipped and when the result is affirmative, the program proceeds to S302, in which it is determined whether the bit of a minimum engine speed flag (described later) is 0.

Since the initial value of this flag is 0, the result in S302 in the first program loop is generally affirmative and the program proceeds to S304, in which the engine speed NE is increased. Specifically, a first prescribed value NEd1 (e.g., 50 rpm) is added to the present desired engine speed NEd and the obtained sum is set as a new desired engine speed NEd.

Consequently, the intake air amount of the engine 30 is regulated (i.e., increased) through the throttle valve 38 and secondary air amount regulation valve 44 so that the engine speed NE is converged to the newly-set desired engine speed NEd. Therefore, the engine speed NE is increased and the propeller rotational speed is also increased accordingly (in other words, the boat speed is slightly accelerated).

When the result in S302 is negative, the program proceeds to S306 onward, which process will be explained later.

In FIG. 7, the program proceeds to S18, in which it is determined whether the rotational speed of the propeller 70 should be decreased.

Figure 11:
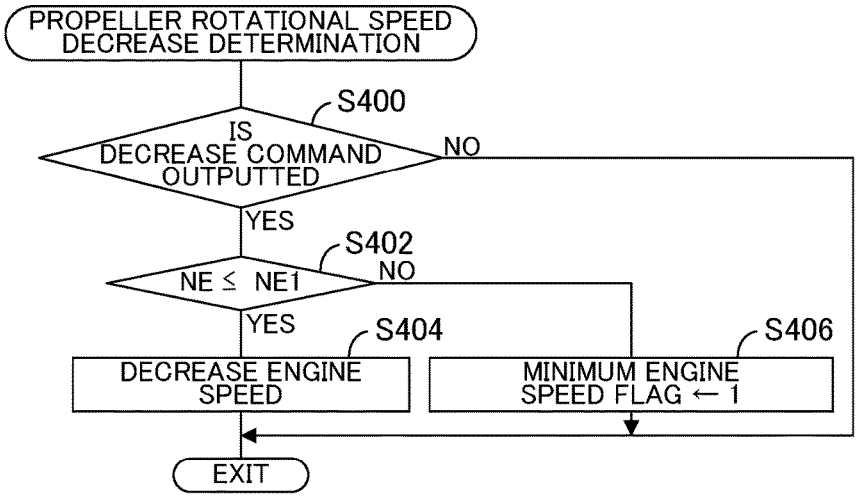
FIG. 11 is a subroutine flowchart showing the operation of propeller rotational speed decrease determination in the FIG. 7 flowchart.

FIG. 11 is a subroutine flowchart showing the operation of the propeller rotational speed decrease determination. First, in S400, it is determined whether the propeller rotational speed decrease command is outputted from the trolling switch 162, i.e., whether the decrease in the propeller rotational speed is instructed by the operator. When the result in S400 is affirmative, the program proceeds to S402, in which it is determined whether the present engine speed NE is greater than a predetermined speed NE1. The predetermined speed NE1 is set to a value lower than an idle speed NEi (e.g., 800 rpm) of the engine 30, which value is also the minimum value (e.g., 700 rpm) in a range that can prevent the engine from stalling.

When the result in S402 is affirmative, the program proceeds to S404, in which the engine speed NE is decreased. Specifically, a second prescribed value NEd2 (e.g., 50 rpm) is subtracted from the present desired engine speed NEd and the obtained difference is set as a new desired engine speed NEd. Consequently, the intake air amount of the engine 30 is regulated (i.e., decreased) through the throttle valve 38 and secondary air amount regulation valve 44. Therefore, the engine speed NE is decreased and the propeller rotational speed is also decreased accordingly (in other words, the boat speed is slightly decelerated).

On the other hand, when the result in S402 is negative, i.e., when the decrease command is again outputted when and after the engine speed NE has been decreased to the predetermined speed NE1, the program proceeds to S406, in which the bit of the minimum engine speed flag is set to 1 and the program is terminated. This flag is set to 1 when the decrease command is outputted at the time the engine speed NE is at or below, more exactly at the predetermined speed NE1, and otherwise, reset to 0.

When the result in S400 is negative, the steps of S402 to S406 are skipped.

In FIG. 7, the program proceeds to S20, in which, based on the engine speed NE and propeller rotational speed decrease command, it is determined whether the gear position (speed) should be changed.

Figure 12:
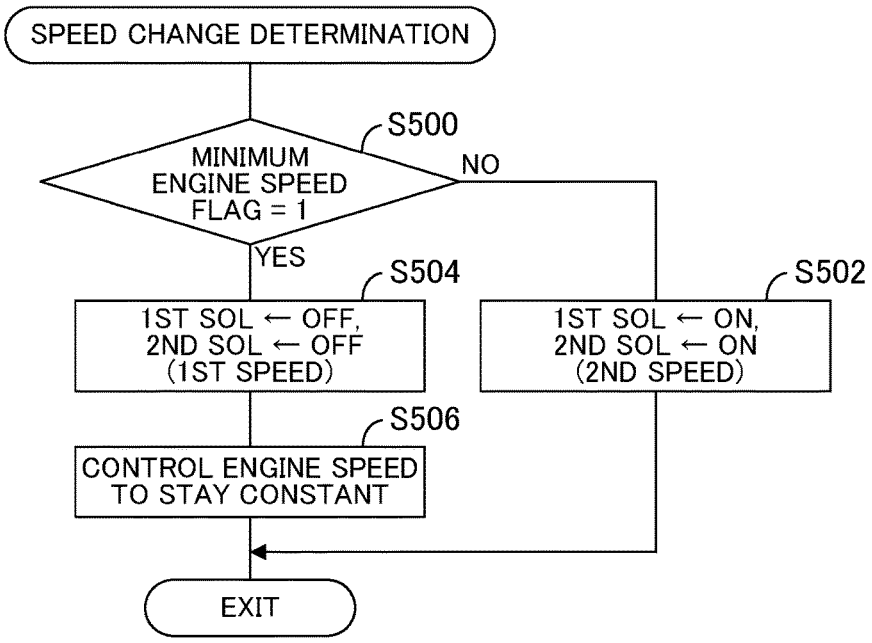
FIG. 12 is a subroutine flowchart showing the operation of speed change determination in the FIG. 7 flowchart.

FIG. 12 is a subroutine flowchart showing the operation of the speed change determination. As shown in FIG. 12, in S500, it is determined whether the bit of the minimum engine speed flag is 1. When the result in S500 is negative, the program proceeds to S502, in which the first and second solenoid valves 116*a*, 116*b* are both made ON so that the second speed is selected (maintained) in the transmission 74.

When the result in S500 is affirmative, the program proceeds to S504, in which the first and second solenoid valves 116*a*, 116*b* are both made OFF to change the gear position (shift down the gear) of the transmission 74 from the second speed to the first speed. As a result, the propeller rotational speed is further decreased, so that the boat speed is also further decreased.

Then the program proceeds to S506, in which the operation of the throttle valve 38 and secondary air amount regulation valve 44 is controlled so that the engine speed NE stays constant, precisely, the engine speed NE of when and after the gear position is changed to the first speed is controlled to be (substantially) equal to the engine speed of before the speed change, whereafter the program is terminated. Thus, since the engine speed NE may be increased due to the change in the gear position to the first speed, the step of S506 is configured to suppress such the increase.

In the case where, after the gear position is changed from the second speed to the first speed in S504, the increase command is outputted from the trolling switch 162, the result in S300 is affirmative and that in S302 is negative, so that the program proceeds to S306. In S306, the first and second solenoid valves 116*a*, 116*b* are both made ON to change the gear position (shift up the gear) from the first speed to the second speed, thereby increasing the propeller rotational speed and increasing the boat speed accordingly.

Next the program proceeds to S308, in which the bit of the minimum engine speed flag is reset to 0 and the program is terminated.

Figure 13:
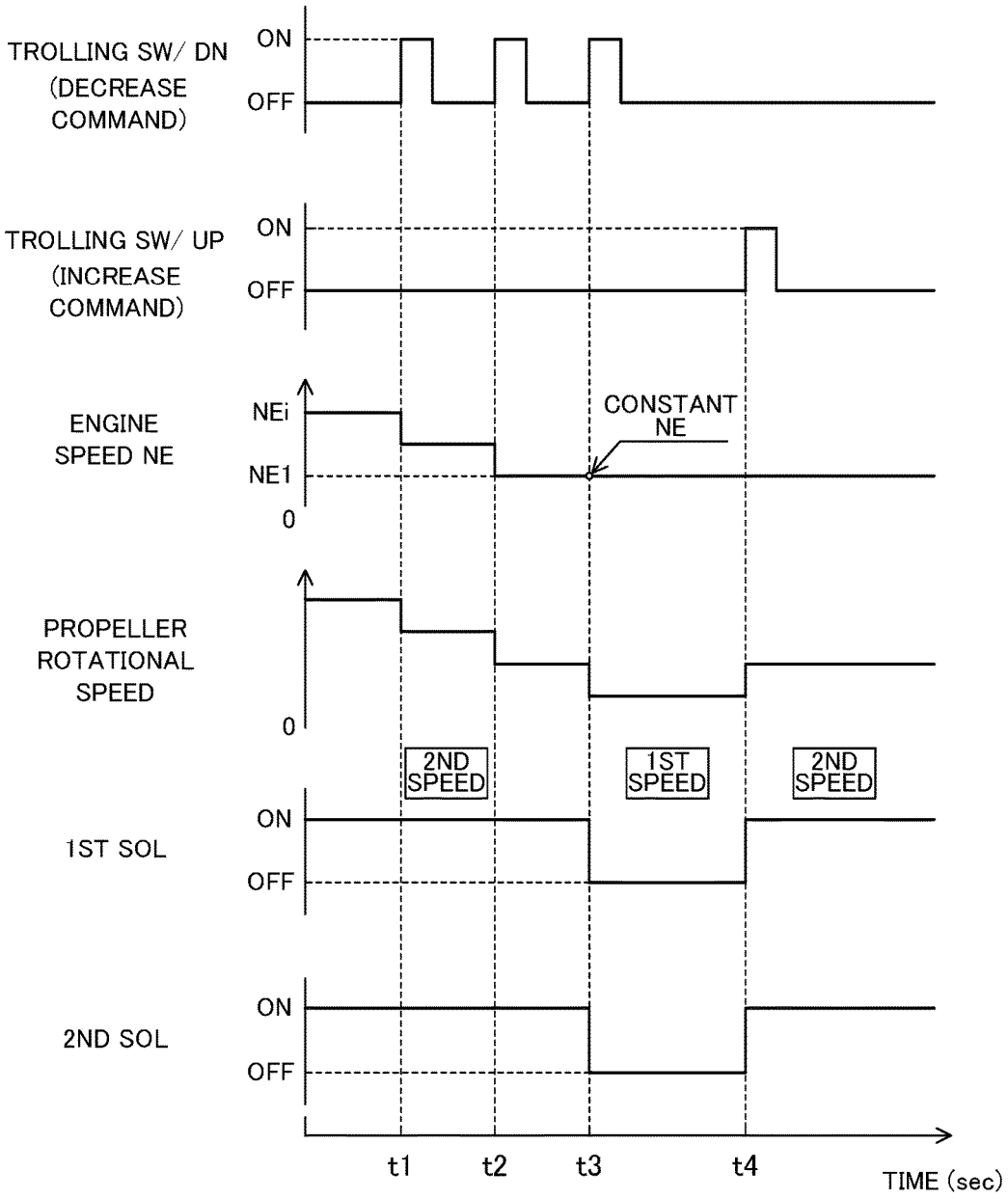
FIG. 13 is a time chart for explaining the operation of the flowcharts of FIGS. 7 and 10 to 12.

FIG. 13 is a time chart for explaining the operation of the flowcharts of FIGS. 7 and 10 to 12, i.e., the propeller rotational speed control operation and transmission control during the cruise at low speed.

Under the condition where the transmission 74 is in the second speed and the engine speed NE is at the idle speed NEi, when, at the time t1, the propeller rotational speed decrease command is outputted through the down switch of the trolling switch 162 (S400), the engine speed NE is decreased by the second prescribed value NEd2 (S404) and the propeller rotational speed is decreased accordingly. The same can be said with respect to the time t2.

When, at the time t3, the decrease command is again outputted at the time the engine speed NE is decreased to the predetermined speed NE1 (S400, S402, S406, S500), the gear position is changed from the second speed to the first speed (S504) and the engine speed NE is controlled to be (substantially) equal to the engine speed of before the speed change (S506). The propeller rotational speed is further decreased accordingly.

After that, when, at the time t4, the increase command is outputted through the up switch of the trolling switch 162 (S300, S302), the gear position is changed from the first speed to the second speed (S306), so that the propeller rotational speed is increased.

As stated above, the embodiment is configured to have an apparatus and a method for controlling operation of an outboard motor 10 adapted to be mounted on a stern 12*a* of a boat 1 and having an internal combustion engine 30 to power a propeller 70 through a drive shaft (input shaft) 84 and a propeller shaft 72, a transmission 74 that is installed at a location between the drive shaft 84 and the propeller shaft 72, the transmission 74 being selectively changeable in gear position to establish speeds including at least a first speed and a second speed and transmitting power of the engine 30 to the propeller 70 with a gear ratio determined by established speed, and a low-speed cruise controller (ECU 140) adapted to control a rotational speed of the propeller 70 to make the boat 1 cruise at low speed, wherein the low-speed cruise controller includes a propeller rotational speed increase/decrease command outputter (trolling switch 162) adapted to output an increase command and decrease command of the rotational speed of the propeller 70 in response to manipulation by the operator; and a first-speed changer (ECU 140, S18, S20, S400, S402, S406, S500, S504) adapted to change the gear position from the second speed to the first speed through the transmission 74 when the decrease command is outputted under a condition where the gear position is in the second speed and a speed NE of the engine is equal to or lower than a predetermined speed NE1.

With this, it becomes possible to set the predetermined speed NE1 to a relatively low value but still capable of preventing the engine 30 from stalling, for instance. Consequently, even when the propeller rotational speed decrease command is outputted at the time the engine speed NE is relatively low, since the gear position is changed to the first speed, the propeller rotational speed can be further decreased while the engine 30 avoids stalling, thereby enabling to make the boat 1 cruise at very low speed (i.e., achieving the creeping speed).

In the apparatus and method, the low-speed cruise controller controls the rotational speed of the propeller 70 by regulating an intake air amount of the engine 30 (S16, S18, S304, S404). With this, it becomes possible to control the propeller rotational speed through the regulation of the intake air amount until the engine speed NE is decreased to the predetermined speed NE1, for instance. Therefore, the propeller rotational speed can be reliably decreased or increased during the low-speed cruise control.

In the apparatus and method, the low-speed cruise controller controls the engine speed NE of when the gear position is changed to the first speed by the first-speed changer to be equal or substantially equal to the engine speed of before the gear position is changed (S20, S506). Since the engine speed NE is not increased due to the change in the gear position to the first speed, it becomes possible to more reliably decrease the propeller rotational speed when the gear position is changed to the first speed.

In the apparatus and method, the low-speed cruise controller includes:

a second-speed changer (ECU 140, S16, S306) adapted to change the gear position from the first speed to the second speed through the transmission 74 when the increase command is outputted after the gear position is changed to the first speed by the first-speed changer. With this, it becomes possible to instantaneously increase the propeller rotational speed.

In the apparatus and method, the propeller rotational speed increase/decrease command outputter comprises a switch (trolling switch 162) installed to be manually operated by an operator. With this, it becomes possible to easily output the propeller rotational speed increase/decrease command with simple structure.

It should be noted that, although the outboard motor is exemplified above, this invention can be applied to an inboard/outboard motor equipped with a transmission.

It should also be noted that, although the predetermined speed NE1, first and second prescribed values NEd1, NEd2, displacement of the engine 30 and other values are indicated with specific values in the foregoing, they are only examples and not limited thereto.

While the invention has thus been shown and described with reference to specific embodiments, it should be noted that the invention is in no way limited to the details of the described arrangements; changes and modifications may be made without departing from the scope of the appended claims.

What is claimed is:

1. An apparatus for controlling operation of an outboard motor configured to be mounted on a stern of a boat and having an internal combustion engine to power a propeller through a drive shaft and a propeller shaft, a transmission that is installed at a location between the drive shaft and the propeller shaft, the transmission being selectively changeable in gear position to establish speeds including at least a first speed and a second speed, each of the first speed and the second speed being in gear positions, and transmitting power of the engine to the propeller with a gear ratio determined by established speed, and a low-speed cruise controller which controls a rotational speed of the propeller to make the boat cruise at low speed, wherein the low-speed cruise controller includes:

a propeller rotational speed increase/decrease command outputter which outputs an increase command and decrease command of the rotational speed of the propeller in response to manipulation by the operator;

a first-speed change mechanism which changes the gear position from the second speed to the first speed through the transmission when the decrease command is outputted under a condition where the gear position is in the second speed and a speed of the engine is equal to or lower than a predetermined speed; and wherein the low-speed cruise controller controls the engine speed of when the gear position is changed to the first speed by the first-speed change mechanism to be equal or substantially equal to the engine speed of before the gear position is changed.

2. The apparatus according to claim 1, wherein the low-speed cruise controller controls the rotational speed of the propeller by regulating an intake air amount of the engine.

3. The apparatus according to claim 1, wherein the low-speed cruise controller includes:

a second-speed change mechanism which changes the gear position from the first speed to the second speed through the transmission when the increase command is outputted after the gear position is changed to the first speed by the first-speed change mechanism.

4. The apparatus according to claim 1, wherein the propeller rotational speed increase/decrease command outputter comprises a switch installed to be manually operated by an operator.

5. The apparatus according to claim 1 wherein the predetermined speed is set to a level lower than an idle speed of the engine.

6. A method for controlling operation of an outboard motor configured to be mounted on a stern of a boat and having an internal combustion engine to power a propeller through a drive shaft and a propeller shaft, and a transmission that is installed at a location between the drive shaft and the propeller shaft, the transmission being selectively changeable in gear position to establish speeds including at least a first speed and a second speed, each of the first speed and the second speed being in gear positions, and transmitting power of the engine to the propeller with a gear ratio determined by established speed, the method executed by a low-speed cruise controller which controls a rotational speed of the propeller to make the boat cruise at low speed and comprising the steps of:

outputting, via a propeller rotational speed increase/decrease command outputter, one of an increase command and a decrease command of the rotational speed of the propeller in response to manipulation by the operator;

changing, via a first-speed change mechanism, the gear position from the second speed to the first speed through the transmission when the decrease command is outputted under a condition where the gear position is in the second speed and a speed of the engine is equal to or lower than a predetermined speed; and wherein the engine speed is controlled when the gear position is changed to the first speed by the step of changing the gear position to the first speed to be equal or substantially equal to the engine speed of before the gear position is changed.

7. The method according to claim 6, wherein the rotational speed of the propeller is controlled by regulating an intake air amount of the engine.

8. The method according to claim 6, further comprising the step of:

changing the gear position from the first speed to the second speed through the transmission when the increase command is outputted after the gear position is changed to the first speed by the step of changing the gear position to the first speed.

9. The method according to claim 6, wherein the propeller rotational speed increase/decrease command outputter comprises a switch installed to be manually operated by an operator.

10. The method according to claim 6, wherein the predetermined speed is set to a value lower than an idle speed of the engine.

* * * * *